US010658763B2

(12) United States Patent
Gallagher et al.

(10) Patent No.: US 10,658,763 B2
(45) **Date of Patent: *May 19, 2020**

(54) PER-ELEMENT POWER CONTROL FOR ARRAY BASED COMMUNICATIONS

(71) Applicant: Maxlinear, Inc., Carlsbad, CA (US)

(72) Inventors: Timothy Gallagher, Carlsbad, CA (US); Curtis Ling, Carlsbad, CA (US)

(73) Assignee: Maxlinear, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/259,177

(22) Filed: Jan. 28, 2019

(65) Prior Publication Data

US 2019/0181563 A1 Jun. 13, 2019

Related U.S. Application Data

(63) Continuation of application No. 15/238,830, filed on Aug. 17, 2016, now Pat. No. 10,218,084.

(60) Provisional application No. 62/206,365, filed on Aug. 18, 2015, provisional application No. 62/206,369, filed on Aug. 18, 2015, provisional application No. 62/248,577, filed on Oct. 30, 2015.

(51) Int. Cl.

| | |
|---|---|
| ***H01Q 21/22*** | (2006.01) |
| ***H01Q 1/38*** | (2006.01) |
| ***H01Q 3/24*** | (2006.01) |
| ***H01Q 3/26*** | (2006.01) |
| ***H01Q 21/06*** | (2006.01) |

(52) U.S. Cl.

CPC ..... *H01Q 21/22* (2013.01); *H01Q 1/38* (2013.01); *H01Q 3/247* (2013.01); *H01Q 3/2605* (2013.01); *H01Q 21/064* (2013.01)

(58) Field of Classification Search

CPC ..... H01Q 21/22; H01Q 1/38; H01Q 3/247; H01Q 3/2605; H01Q 21/064

See application file for complete search history.

(56) References Cited

U.S. PATENT DOCUMENTS

| | | | | |
|---|---|---|---|---|
| 10,218,084 | B2 * | 2/2019 | Gallagher | H01Q 21/22 |
| 2003/0224822 | A1 * | 12/2003 | Park | H04B 1/04 455/557 |
| 2009/0092250 | A1 * | 4/2009 | Lablans | G06F 7/582 380/255 |
| 2012/0093209 | A1 | 4/2012 | Schmidt et al. | |
| 2012/0274514 | A1 * | 11/2012 | Petersson | H01Q 3/26 342/373 |

(Continued)

*Primary Examiner* — Nguyen T Vo

(74) *Attorney, Agent, or Firm* — McAndrews, Held & Malloy, Ltd.

(57) ABSTRACT

An array based communications system may comprise a plurality of element processors. Each element processor may comprise a combining circuit, a crest factor circuit, and a phase shifter circuit. The combining circuit may produce a weighted sum of a plurality of digital datastreams. The crest factor circuit may be operable to determine whether the weighted sum has a power above or below a power threshold. If the power is above the power threshold, the crest factor circuit is operable to reduce the power. If the power is below the power threshold, the crest factor circuit is operable to increase the power. The phase shifter circuit may introduce a phase shift to out-of-band components of the weighted sum according to the power increase or the power decrease by the crest factor circuit.

18 Claims, 21 Drawing Sheets

(56) References Cited

U.S. PATENT DOCUMENTS

| | | | |
|---|---|---|---|
| 2016/0149600 | A1 | 5/2016 | Mege et al. |
| 2016/0182136 | A1 | 6/2016 | Zhang et al. |

* cited by examiner

PER-ELEMENT POWER CONTROL FOR ARRAY BASED COMMUNICATIONS

CROSS-REFERENCE TO RELATED APPLICATIONS/INCORPORATION BY REFERENCE

This patent application which is a continuation application of U.S. application Ser. No. 15/238,830, which was filed Aug. 17, 2016, makes reference to, claims priority to, and claims the benefit from U.S. Provisional Application Ser. No. 62/206,365, which was filed on Aug. 18, 2015; U.S. Provisional Application Ser. No. 62/206,369, which was filed on Aug. 18, 2015; and U.S. Provisional Application Ser. No. 62/248,577, which was filed on Oct. 30, 2015. Each of the above applications is hereby incorporated herein by reference in its entirety.

BACKGROUND

Limitations and disadvantages of conventional methods and systems for communication systems will become apparent to one of skill in the art, through comparison of such systems with some aspects of the present invention as set forth in the remainder of the present application with reference to the drawings.

BRIEF SUMMARY OF THE INVENTION

Systems and methods are provided for per-element power control for array based communications, substantially as shown in and/or described in connection with at least one of the figures, as set forth more completely in the claims.

Advantages, aspects and novel features of the present disclosure, as well as details of an illustrated embodiment thereof, will be more fully understood from the following description and drawings.

BRIEF DESCRIPTION OF SEVERAL VIEWS OF THE DRAWINGS

FIG. 4D illustrates use of an antenna weighting window and window-weighted clipping thresholds for driving the example array of FIG. 4C.

DETAILED DESCRIPTION OF THE INVENTION

Figure 1A:
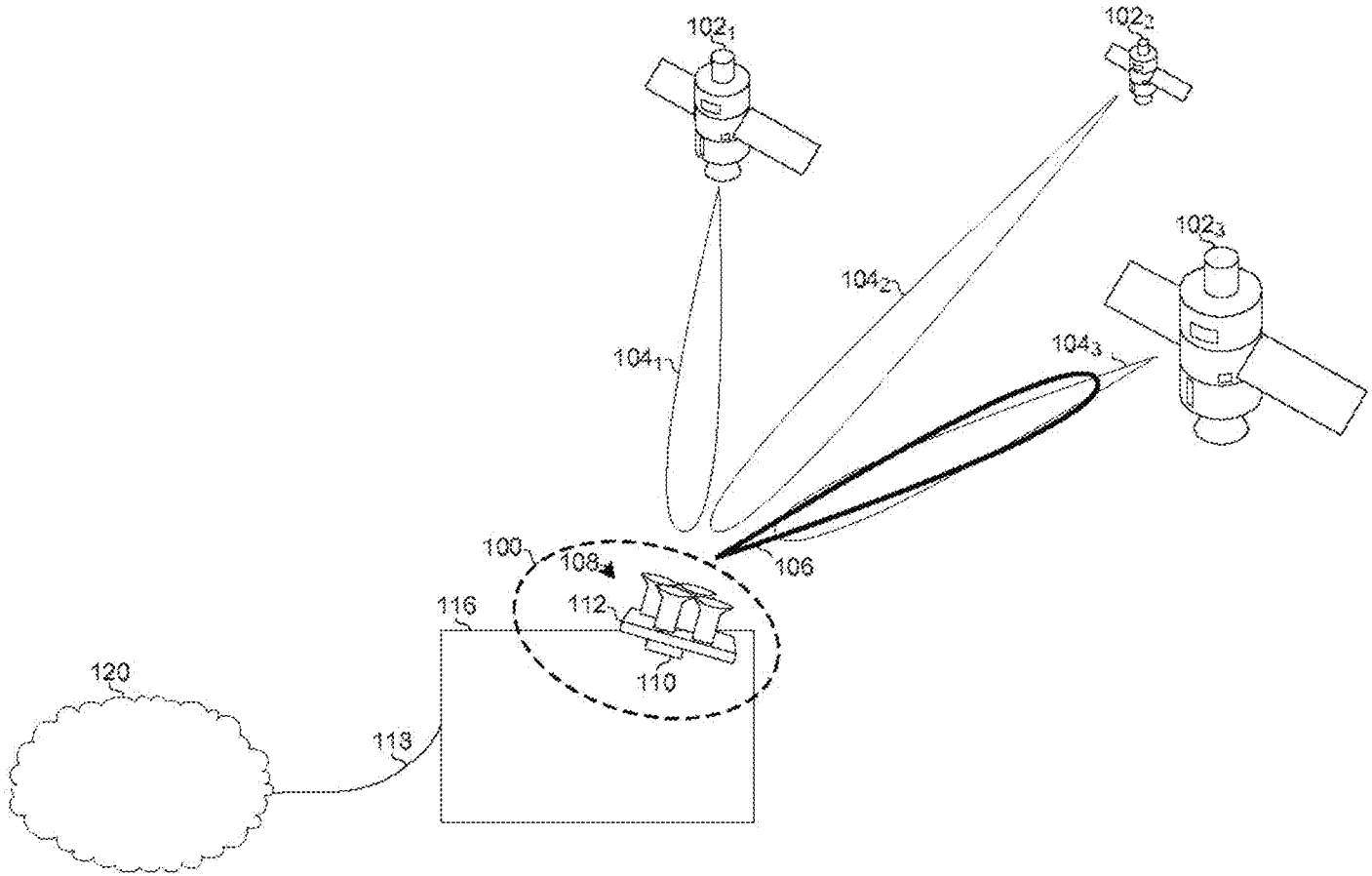
FIG. 1A shows a single-unit-cell transceiver array communicating with a plurality of satellites.

FIG. 1A shows a single-unit-cell transceiver array communicating with a plurality of satellites. Shown in FIG. 1A is a device 116 comprising a transceiver array 100 operable to communicate with a plurality of satellites 102. The device 116 may, for example, be a phone, laptop computer, or other mobile device. The device 116 may, for example, be a desktop computer, server, or other stationary device. In the latter case, the transceiver array 100 may be mounted remotely from the housing of the device 116 (e.g., via fiber optic cables). Device 116 is also connected to a network (e.g., LAN and/or WAN) via a link 118.

Figure 2A:
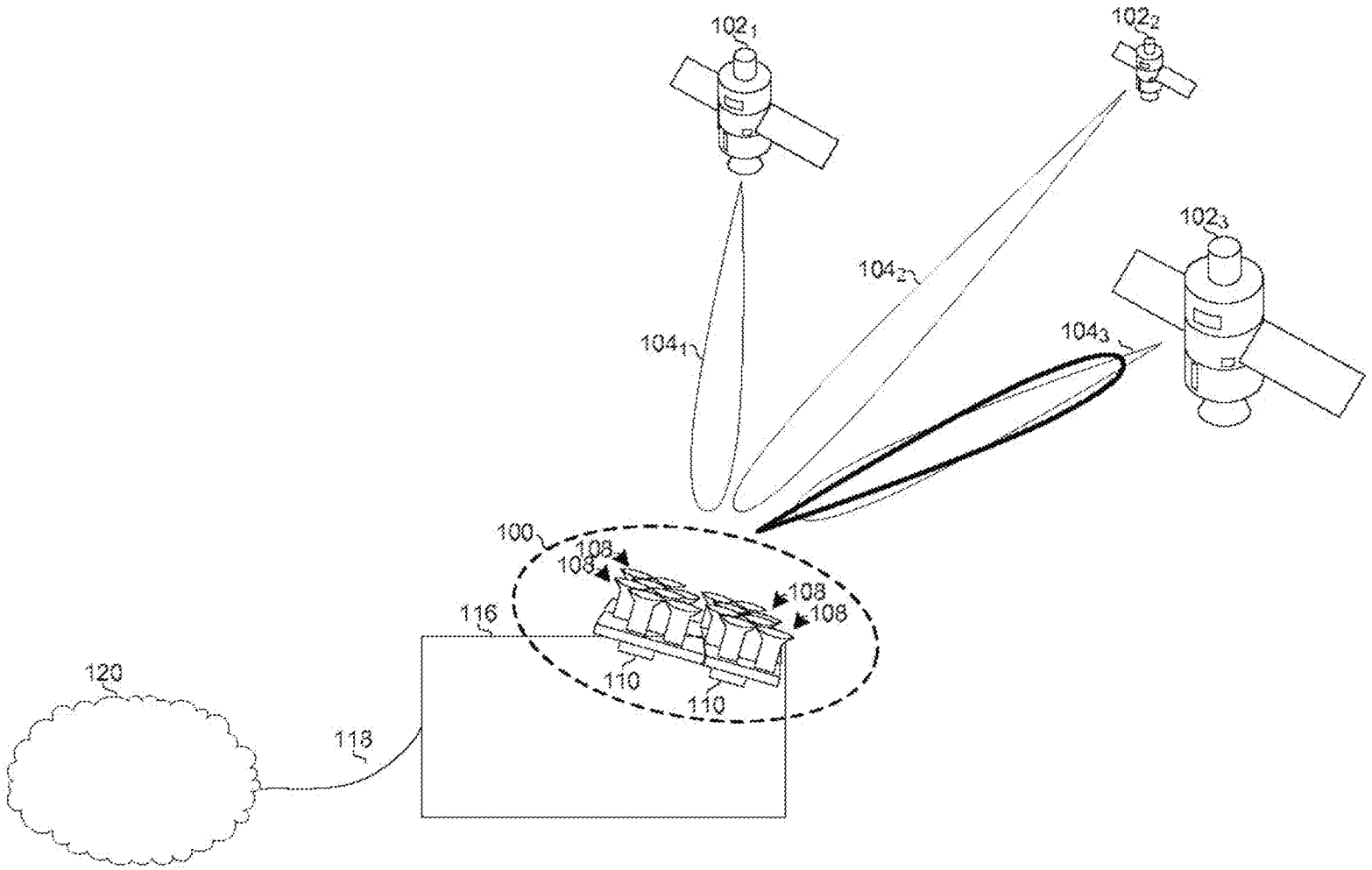
FIG. 2A shows a transceiver which comprises a plurality of the unit cells of FIG. 1B and is communicating with a plurality of satellites.

In an example implementation, the satellites 102 shown in FIGS. 1A and 2A are just a few of hundreds, or even thousands, of satellites having a faster-than-geosynchronous orbit. For example, the satellites may be at an altitude of approximately 1100 km and have an orbit periodicity of around 100 minutes.

Figure 3:
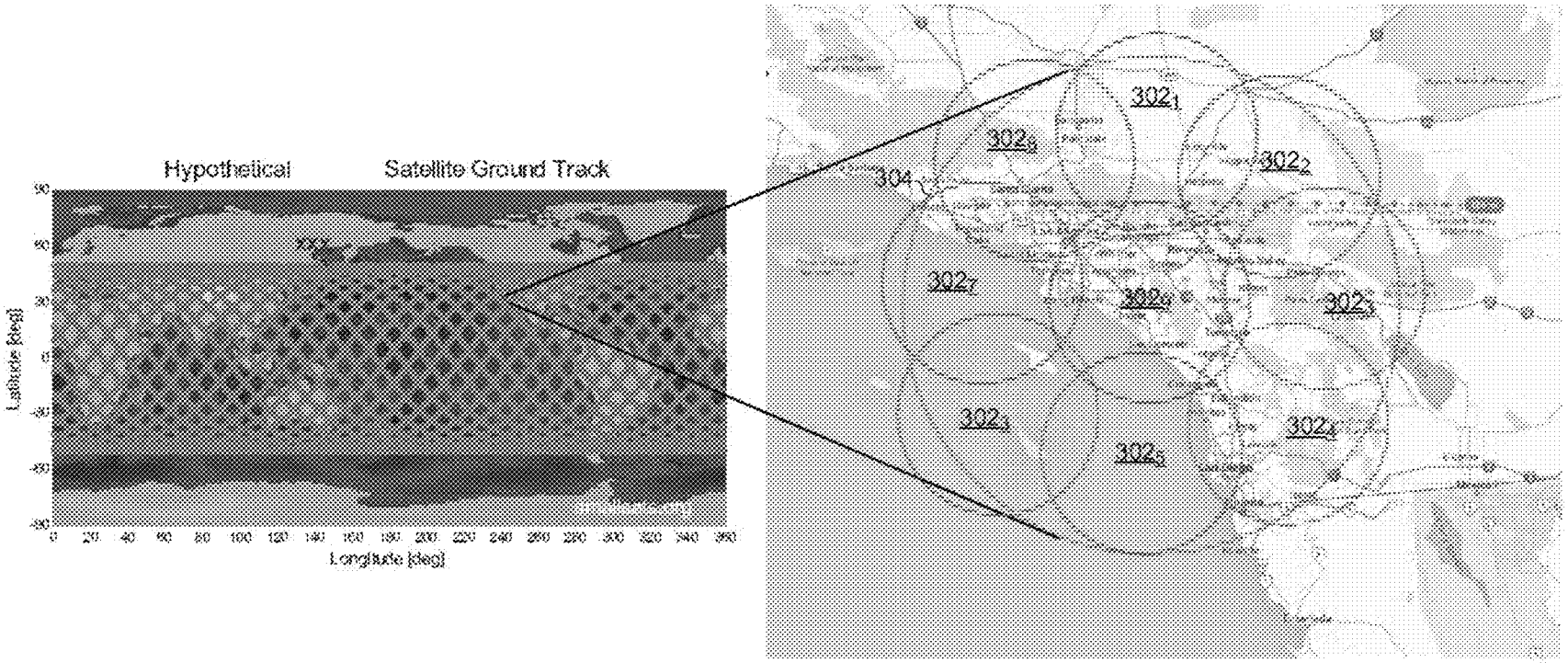
FIG. 3 shows a hypothetical ground track of a satellite system in accordance with aspects of this disclosure.

Each of the satellites 102 may, for example, be required to cover 18 degrees viewed from the Earth's surface, which may correspond to a ground spot size per satellite of ~150 km radius. To cover this area (e.g., area 304 of FIG. 3), each satellite 102 may comprise a plurality of antenna elements generating multiple spot beams (e.g., the nine spot beams 302 of FIG. 3). In an example implementation, each of the satellites 102 may comprise one or more transceiver array, such as the transceiver array 100 described herein, operable to implement aspects of this disclosure. This may enable steering the coverage area of the spot beams without having to mechanically steer anything on the satellite 102. For example, when a satellite 102 is over a sparsely populated area (e.g., the ocean) but approaching a densely populated area (e.g., Los Angeles), the beams of the satellite 102 may be steered ahead such that they linger on the sparsely populated area for less time and on the densely populated area for more time, thus providing more throughput where it is needed.

Figure 1B:
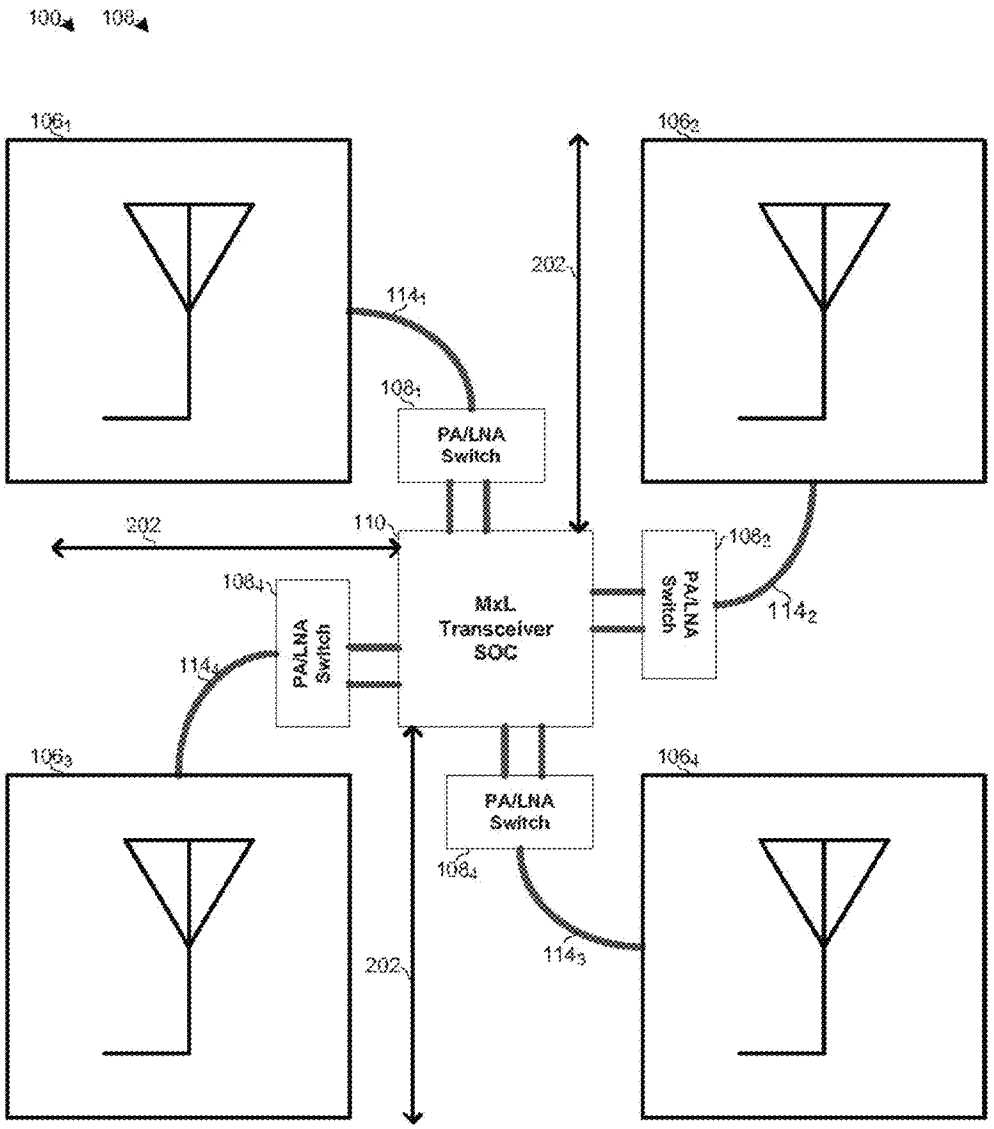
FIG. 1B shows details of an example implementation of the single-unit-cell transceiver array of FIG. 1A.
Figure 2B:
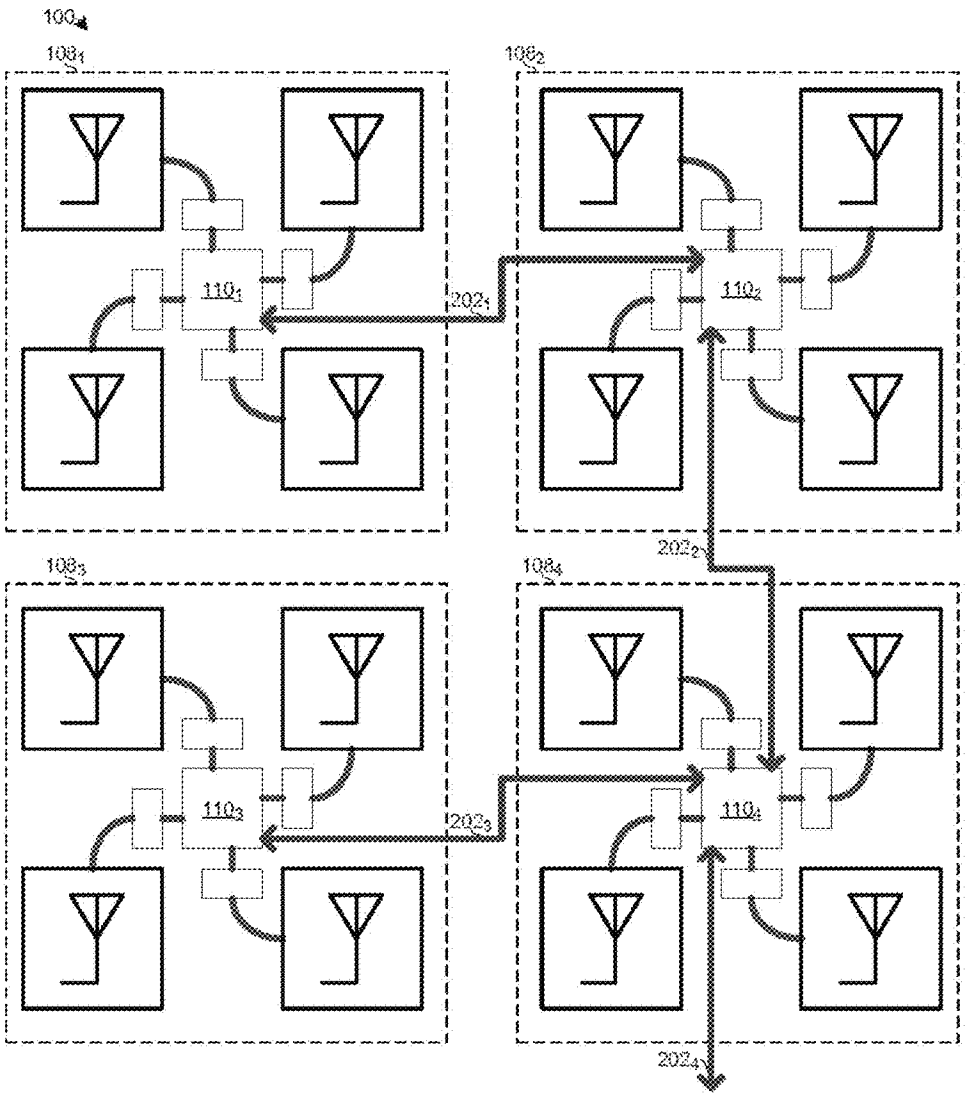
FIG. 2B shows details of an example implementation of the transceiver of FIG. 1A.
Figure 4A:
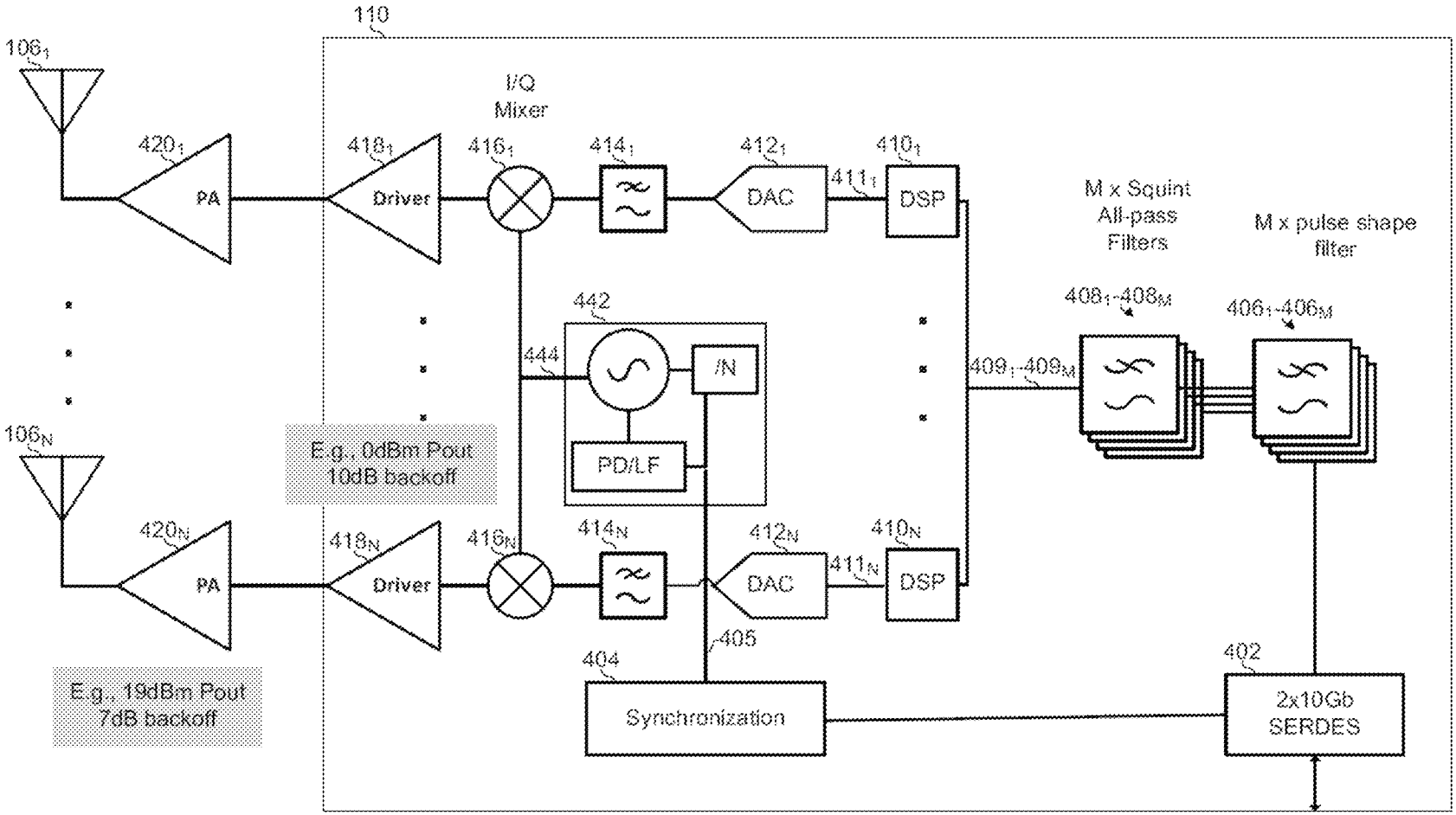
FIG. 4A depicts transmit circuitry of an example implementation of the unit cell of FIG. 1B.

As shown in FIG. 1B, an example unit cell 108 of a transceiver array 100 comprises a plurality of antenna elements 106 (e.g., four antenna elements per unit cell 108 in the examples of FIGS. 1B and 2B; and 'N' per unit cell in the example of FIG. 4A), a transceiver circuit 110, and, for a time-division-duplexing (TDD) implementation, a plurality of transmit/receive switches 108. The respective power amplifiers (PAs) for each of the four antenna elements $\mathbf{106}_1$-$\mathbf{106}_4$ are not shown explicitly in FIG. 1B but may, for example, be integrated on the circuit 110 or may reside on a dedicated chip or subassembly (as shown, for example, in FIG. 4A, below). The antenna elements 106, circuit 110, and circuit 108 may be mounted to a printed circuit board (PCB) 112 (or other substrate). The components shown in FIG. 1B are referred to herein as a "unit cell" because multiple instances of this unit cell 108 may be ganged together to form a larger transceiver array 100. In this manner, the architecture of a transceiver array 100 in accordance with various implementations of this disclosure may be modular and scalable. FIGS. 2A and 2B, for example, illustrate an implementation in which four unit cells 108, each having four antenna elements 106 and a transceiver circuit 110, have been ganged together to form a transceiver array 100 comprising sixteen antenna elements 106 and four transceiver circuits 110. The various unit cells 108 are coupled via lines 202 which, in an example implementation represent one or more data busses (e.g., high-speed serial busses similar to what is used in backplane applications) and/or one or more clock distribution traces (which may be referred to as a "clock tree," as described below with reference to FIGS. 11A, 11B, 12A, and 12B).

Use of an array of antenna elements 106 enables beamforming for generating a radiation pattern having one or more high-gain beams. In general, any number of transmit and/or receive beams are supported.

In an example implementation, each of the antenna elements 106 of a unit cell 108 is a horn mounted to a printed circuit board (PCB) 112 with waveguide feed lines 114. The circuit 110 may be mounted to the same PCB 112. In this manner, the feed lines 114 to the antenna elements may be kept extremely short. For example, the entire unit cell 108 may be, for example, 6 cm by 6 cm such that length of the feed lines 114 may be on the order of centimeters. The horns may, for example, be made of molded plastic with a metallic coating such that they are very inexpensive. In another example implementation, the antenna elements 106 may be, for example, stripline or microstrip patch antennas.

The ability of the transceiver array 100 to use beamforming to simultaneously receive from multiple of the satellites 102 may enable soft handoffs of the transceiver array 110 between satellites 102. Soft handoff may reduce downtime as the transceiver array 100 switches from one satellite 102 to the next. This may be important because the satellites 102 may be orbiting at speeds such that any particular satellite 102 only covers the transceiver array 100 for on the order of 1 minute, thus resulting in very frequent handoffs. For example, satellite $\mathbf{102}_3$ may be currently providing primary coverage to the transceiver array 100 and satellite $\mathbf{102}_1$ may be the next satellite to come into view after satellite $\mathbf{102}_3$. The transceiver array 100 may be receiving data via beam $\mathbf{104}_3$ and transmitting data via beam 106 while, at the same time, receiving control information (e.g., a low data rate beacon comprising a satellite identifier) from satellite $\mathbf{102}_1$ via beam $\mathbf{104}_1$. The transceiver array 100 may use this control information for synchronizing circuitry, adjusting beamforming coefficients, etc., in preparation for being handed-off to satellite $\mathbf{102}_1$. The satellite to which the transceiver array 100 is transmitting may relay messages (e.g., ACKs or retransmit requests) to the other satellites from which transceiver array 100 is receiving.

FIG. 4A depicts transmit circuitry of an example implementation of the unit cell of FIG. 1B. In the example implementation shown, circuit 110 comprises a SERDES interface circuit 402, synchronization circuit 404, local oscillator generator 442, pulse shaping filters $\mathbf{406}_1$-$\mathbf{406}_M$ (M being an integer greater than or equal to 1), squint filters $\mathbf{408}_1$-$\mathbf{408}_M$, per-element digital signal processing circuits $\mathbf{410}_1$-$\mathbf{410}_N$, DACs $\mathbf{412}_1$-$\mathbf{412}_N$, filters $\mathbf{414}_1$-$\mathbf{414}_N$, mixers $\mathbf{416}_1$-$\mathbf{416}_N$, and drivers $\mathbf{418}_1$-$\mathbf{418}_N$. The outputs of the PA drivers $\mathbf{418}_1$-$\mathbf{418}_N$ are amplified by PAs $\mathbf{420}_1$-$\mathbf{420}_N$ before being transmitted via antenna elements $\mathbf{106}_1$-$\mathbf{106}_N$.

The SERDES interface circuit 402 is operable to exchange data with other instance(s) of the circuit 110 and other circuitry (e.g., a CPU) of the device 116.

The synchronization circuit 404 is operable to aid synchronization of a reference clock of the circuit 110 with the reference clocks of other instance(s) of the circuit 110 of the transceiver array 100.

The local oscillator generator 442 generates one or more local oscillator signals 444 based on the reference signal 405.

The pulse shaping filters $\mathbf{406}_1$-$\mathbf{406}_M$ (M being an integer greater than or equal to 1) are operable to receive bits to be transmitted from the SERDES interface circuit 402 and shape the bits before conveying them to the M squint processing filters $\mathbf{408}_1$-$\mathbf{408}_M$. In an example implementation, each pulse shaping filter $\mathbf{406}_m$ processes a respective one of M datastreams from the SERDES interface circuit 402.

Each of the squint filters $\mathbf{408}_1$-$\mathbf{408}_M$ is operable to compensate for the relatively wide bandwidth of the signals $\mathbf{409}_1$-$\mathbf{409}_M$, such that the signals $\mathbf{409}_1$-$\mathbf{409}_M$ can be phase shifted by circuits $\mathbf{410}_1$-$\mathbf{410}_N$ without causing different transmit directionalities for different frequencies (i.e., without the squint filters/processors 408, application of a uniform phase shift across all frequencies of a signal $\mathbf{409}_m$ may result in different frequencies pointing in different directions). Each squint filter/processor $\mathbf{408}_m$ is operable to receive a datastream $\mathbf{407}_m$, process it to compensate for squint effects, and then outputs it to an associated one or more transmit paths (each transmit path corresponding to one of antenna elements $\mathbf{106}_1$-$\mathbf{106}_N$). In the example shown, each squint filter $\mathbf{408}_m$ (m being an integer between 1 and M) processes datastream $\mathbf{407}_m$ to generate signal $\mathbf{409}_m$, which is then output to each of the N transmit paths. Thus, in this example, for C (an integer) instances of circuit 110 in a transceiver array 100, each squint processor/filter $\mathbf{408}_m$ handles squint processing for N of the N×C antenna elements 106 of the transceiver array 100. Which N antenna elements of the total of N×C antennas are coupled to any particular one of the C circuits 110 may be selected based on the squint effects seen at those elements (e.g., a first group of N antenna elements 106 which are a similar distance from a feed point of the antenna array may be coupled to a first circuit 110, a second group of N antenna elements 106 which are a similar distance from a feed point of the antenna array may be coupled to a second circuit 110, and so on).

In another example implementation, each beam $\mathbf{407}_m$ may be coupled to a plurality of the squint filters/processors $\mathbf{408}_1$-$\mathbf{408}_M$, and the output of each of the squint filters/ processors 408$_1$-408 may go to only a subset of the N antenna elements (a subset experiencing similar squint effects).

The number of squint processors/filters 408 (i.e., the value of M) and/or the number of 408$_1$-408$_M$ which are active (i.e., not powered down) on a circuit 110 may be configured based on a trade-off between power consumption and ability to tolerate squint effects. In general, squint effects are less pronounced for smaller arrays. Thus, aspects of this disclosure enable dividing the large array of N×C elements into smaller subarrays (e.g., of C, or fewer, elements) where the subarray is small enough—and the squint effects they experience similar enough—that uniform squint processing can be applied across the signals fed to the subarray.

In an example implementation, the compensation applied by a squint processor/filter 408 may be dither (e.g., pseudorandomly) between the multiple values (e.g., the two values closest to the desired value), such that side lobes resulting from quantizing the squint values are spread out.

Each of the per-element digital signal processing circuits 410$_1$-410$_N$ is operable to perform processing on the signals 409$_1$-409$_M$. Each one of the circuits 410$_1$-410$_N$ may be configured independently of each of the other ones of the circuits 410$_1$-410$_N$ such that each one of the signals 411$_1$-411$_N$ may be processed as necessary/desired without impacting the other ones of the signals 411$_1$-411$_N$. An example implementation of the per-element signal processing circuit 410 is described below with reference to FIG. 4B.

Each of the DACs 412$_1$-412$_N$ is operable to convert a respective one of the digital signals 411$_1$-411$_N$ to an analog signal. Each of the filters 414$_1$-414$_N$ is operable to filter (e.g., anti-alias filtering) the output of a respective one of the DACs 412$_1$-412$_N$. Each of the mixers 416$_1$-416$_N$ is operable to mix an output of a respective one of the filters 414$_1$-414$_N$ with the local oscillator signal 444. Each of the PA drivers 418$_1$-418$_N$ conditions an output of a respective one of the mixers 416$_1$-416$_N$ for output to a respective one of PAs 420$_1$-420$_N$. In a non-limiting example, each PA driver 418$_n$ (n being an integer between 1 and N) is operated at 10 dB from its saturation point and outputs a 0 dBm signal. In a non-limiting example, each PA 420$_n$ is operated at 7 dB from its saturation point and outputs a 19 dBm signal.

Figure 4B:
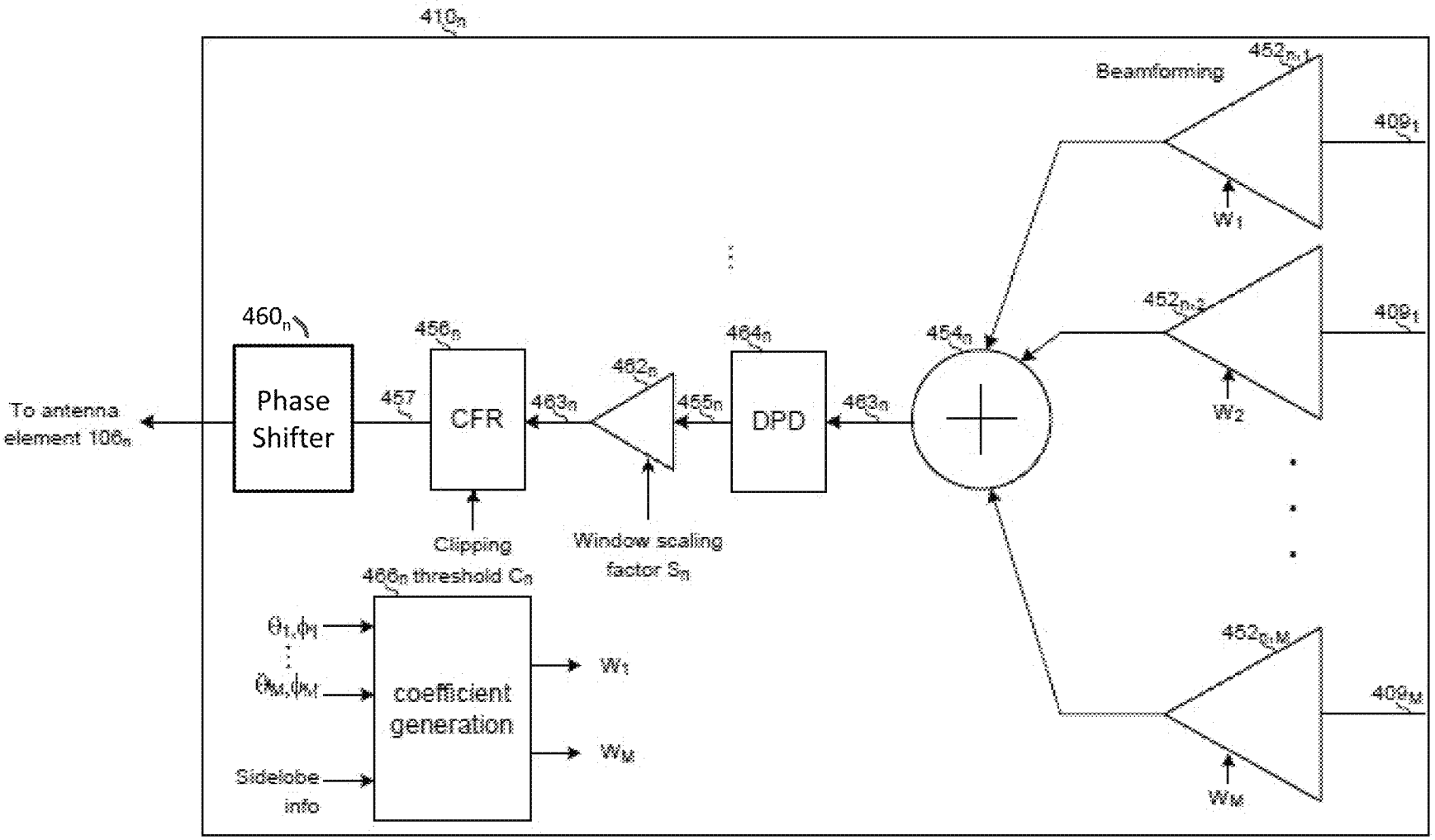
FIG. 4B depicts an example implementation of the per-element digital signal processing circuit of FIG. 4A.

FIG. 4B depicts an example implementation of the per-element digital signal processing circuit of FIG. 4A. The circuit 410$_n$ comprises complex scaling circuits 452$_1$-452$_M$, a summer 454, a scaling circuit 462, a crest factor reduction circuit 456, a digital predistortion circuit 464, and coefficient generation circuit 466.

The weight generation circuit 466 receives the azimuthal angle $\theta_m$ and the elevation angle $\phi_m$ for each beam m of the M beams to be transmitted. The weight generation circuit 466 also receives information about one or more sidelobes that is desired to suppress/cancel. The sidelobes may be the result of the operations performed by the CFR circuit 456. Example details of selecting the sidelobes to be suppressed and calculating the coefficients $L_1^d$ to $L_M^d$ are described below with reference to FIG. 10. An example implementation of the weight generation circuitry 466 is described below with reference to FIG. 4G.

Each of the complex scaling circuits 452$_1$-452$_M$ is operable to apply a complex beamforming coefficient generated by circuit 466 to (i.e., adjust the phase and amplitude of) a respective one of signals 409$_1$-409$_M$.

The summer 454 is operable to combine the M signals from the scaling circuits 452$_1$-452$_M$ to generate signal 463.

The digital predistortion circuit 464 is operable to modify ("predistort") the signal 463$_n$ to generate signal 455$_n$ the result of the predistortion being suppression/cancellation of out-of-band distortion which will subsequently be generated by crest factor reduction circuit 456.

The scaling circuit 462$_n$ is operable to apply a gain $S_n$ according to the array weighting window in use. Accordingly, the gain $S_n$ used for any particular antenna element 106$_n$ may depend on the position of the antenna 106$_n$ within the array. For example, referring to the example nine-element array of FIG. 4C, the gain $S_1$ applied by scaling element 462$_1$ may be different than the gain $S_2$ and so on. In an example implementation, the gain $S_n$ of any scaling element 462$_n$ may be a function of the X and Y indexes of antenna element 106*n*. As just one example, for values of n from 1-9 in the example of FIG. 4C, $S_n$ may depend on $\sqrt{X_n^2+Y_n^2}$ (i.e., depend on the distance from the center of the array), where $X_n$ is the X index of antenna element 106$_n$ (e.g., $X_n=-1$ for n=1, $X_n=0$ for n=2, $X_n=1$ for n=3, $X_n=-1$ for n=4, and so on), and $Y_n$ is the Y index of antenna element 106$_n$ (e.g., $Y_n=1$ for n=1, $Y_n=1$ for n=2, $Y_n=1$ for n=3, $Y_n=0$ for n=4, and so on).

Returning to FIG. 4B, The crest factor reduction circuit 456 then operates on the signal 463 to determine if reduction of its peak-to-average power ratio (PAPR) is desired and, if so, to try and reduce the PAPR. In this manner, the PAPR may be managed separately for each transmit chain/antenna element.

In an example implementation, each circuit 410$_n$ also comprises a circuit 460 to manage spectral regrowth/out-of-band power that results from clipping. Each circuit 460 may be configured to introduce a phase shift to out-of-band frequencies while leaving the phase of in-band frequencies unaffected. In this manner, undesired side lobes resulting from clipping may be suppressed to minimize their impact at the receiver. For example, each circuit 460 may introduce a random phase shift to the out-of-band power resulting from clipping in the various transmit paths does not coherently combine in the direction of an intended receiver (e.g., the out-of-band power may be scattered randomly over a wide range of angles). Alternatively, each circuit 460 may introduce a phase shift to the out-of-band power in the various transmit paths such that the undesired side lobes coherently combine in a direction away from the intended receiver(s).

Figure 4C:
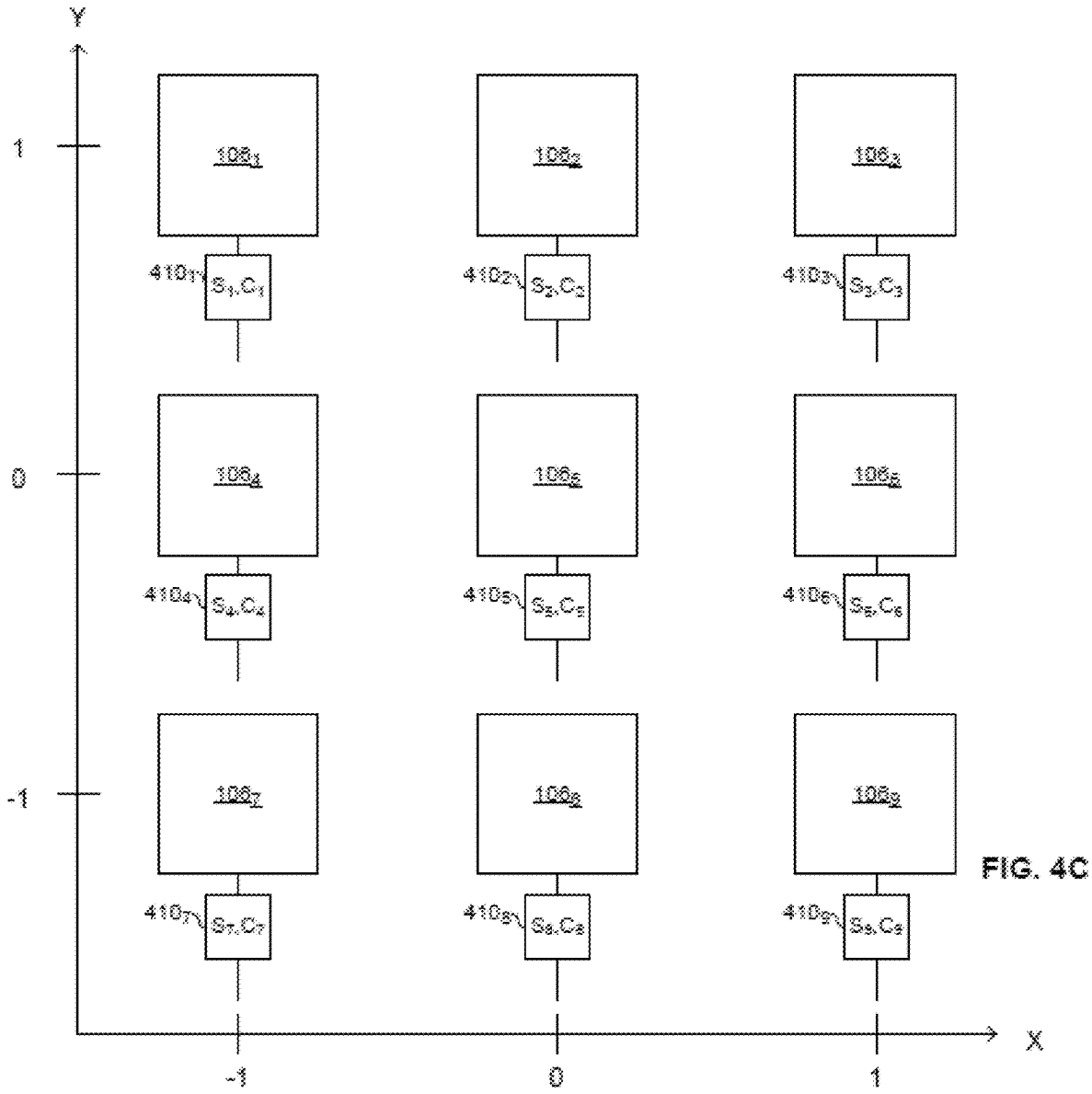
FIG. 4C depicts an example nine-element antenna array.
Figure 4D:
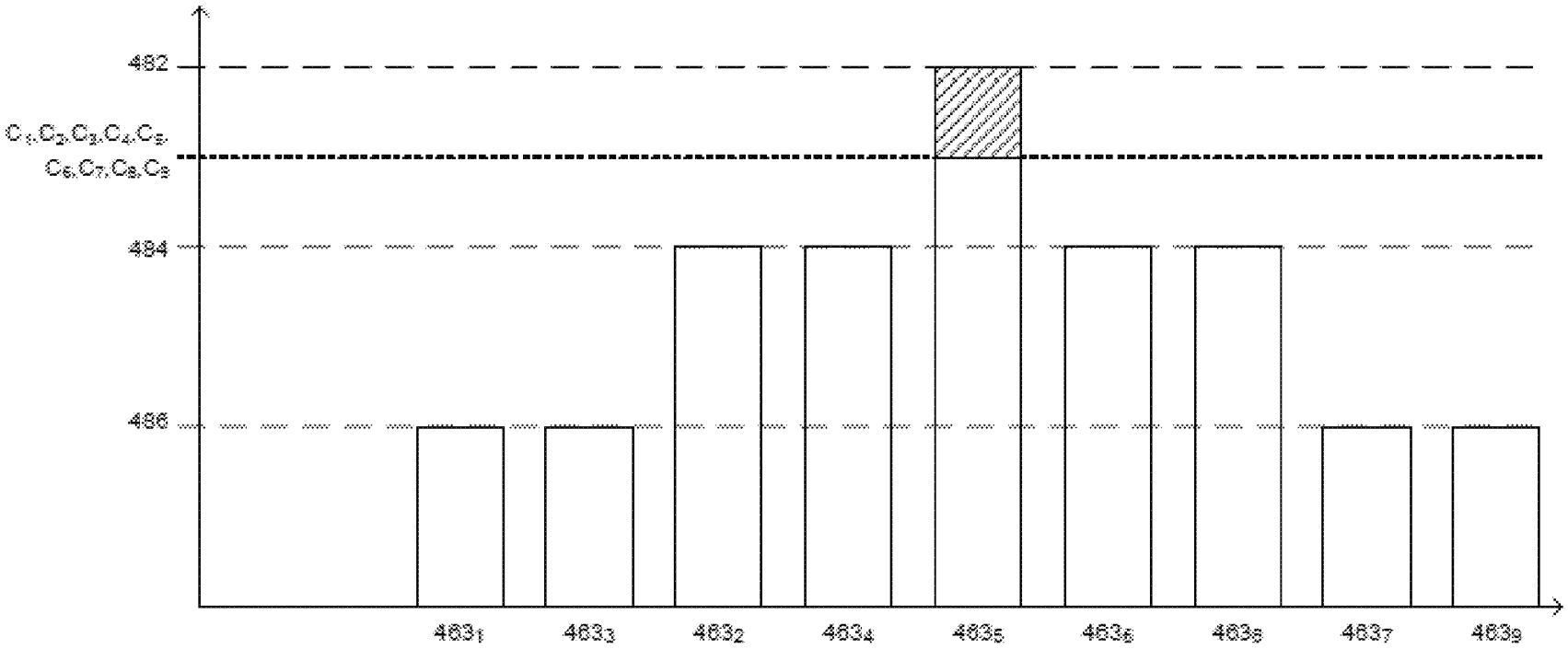
FIG. 4D illustrates use of an antenna weighting window and single clipping threshold for driving the example array of FIG. 4C.
Figure 4E:
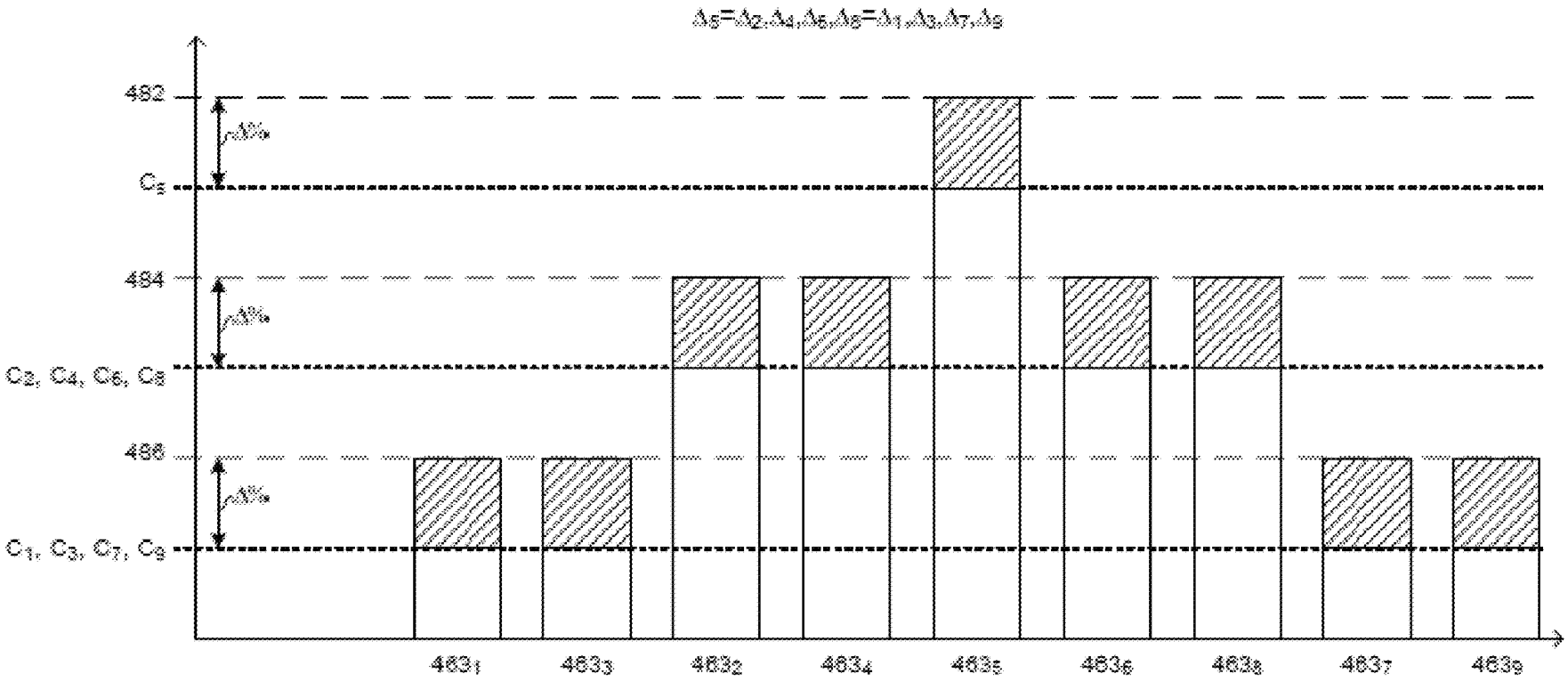
FIG. 4E illustrates use of an antenna weighting window and tapered clipping thresholds for driving the example array of FIG. 4C.
Figure 4F:
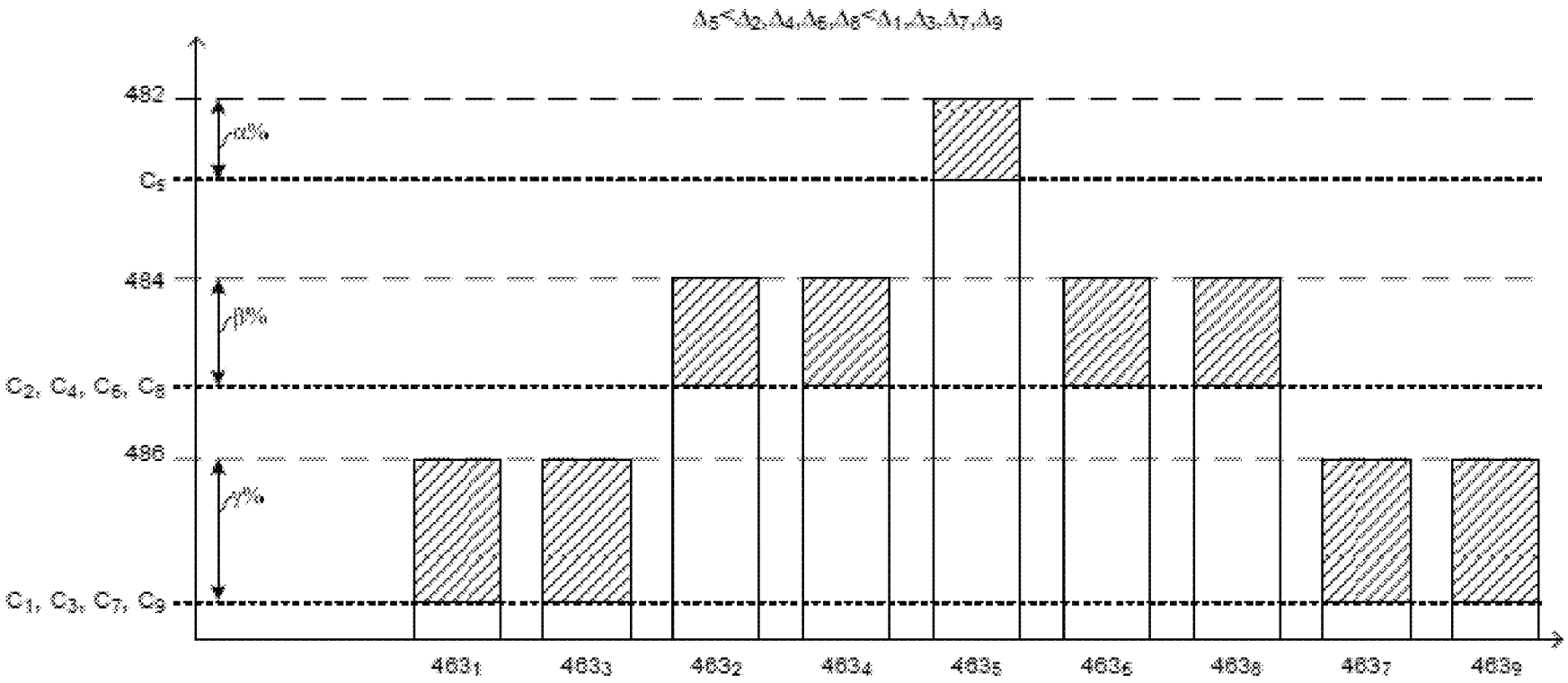
FIG. 4F illustrates use of an antenna weighting window and tapered clipping thresholds for driving the example array of FIG. 4C.
Figure 6:
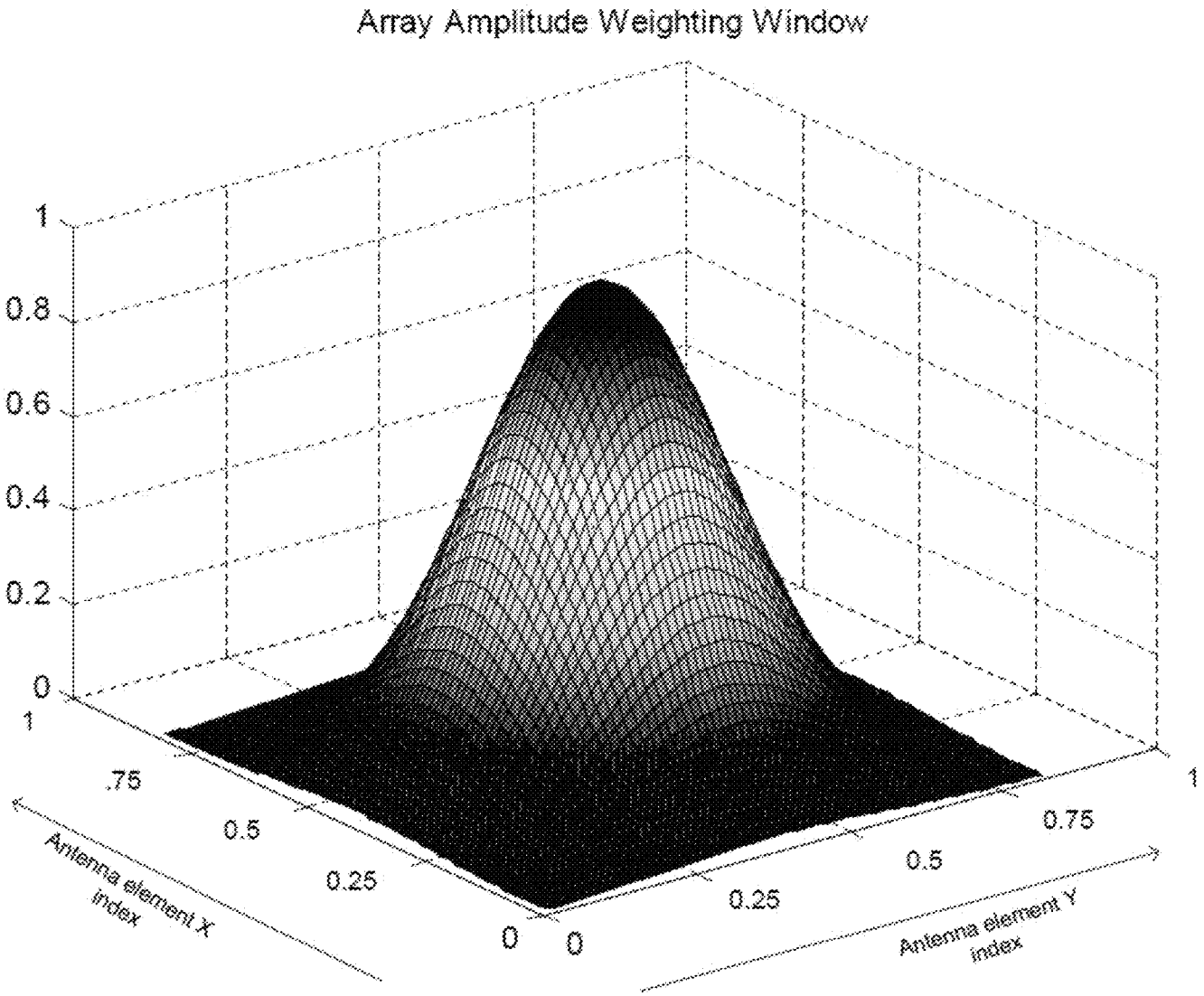
FIG. 6 illustrates an example weighting window applied to an array of antenna elements.

PAPR reduction performed by circuit 456$_n$ comprises digitally clipping the signal 463 if it is above a determined clipping threshold $C_n$. 4D-4F illustrate three example clipping techniques for the example nine-antenna array of FIG. 4C. In each of FIGS. 4D-4F, $S_5$ is set such that the peak power of signal 463$_5$ is level 482; $S_1$, $S_3$, $S_7$, and $S_9$ are set such that the peak power of each of signals 463$_1$, 463$_3$, 463$_7$, and 463$_9$ is level 484; and $S_2$, $S_4$, $S_6$, and $S_8$ are set such that the peak power of each of signals 463$_2$, 463$_4$, 463$_6$, and 463$_8$ is level 486. This weighting window is just an example and is used in each of FIGS. 4D-4F for comparison of various clipping techniques. A 3-D plot of this type of weighting window is shown in FIG. 6. It is also noted that, for purposes of illustration, each signal 463$_1$-463$_9$ in FIGS. 4D-4F is shown swinging to the limit determined by the weighting window. In another example implementation, the CFR circuit 456 performs soft compression instead of, or in addition to, clipping. For example, it may perform soft compression above a first threshold and then clipping above a second threshold.

Figure 7A:
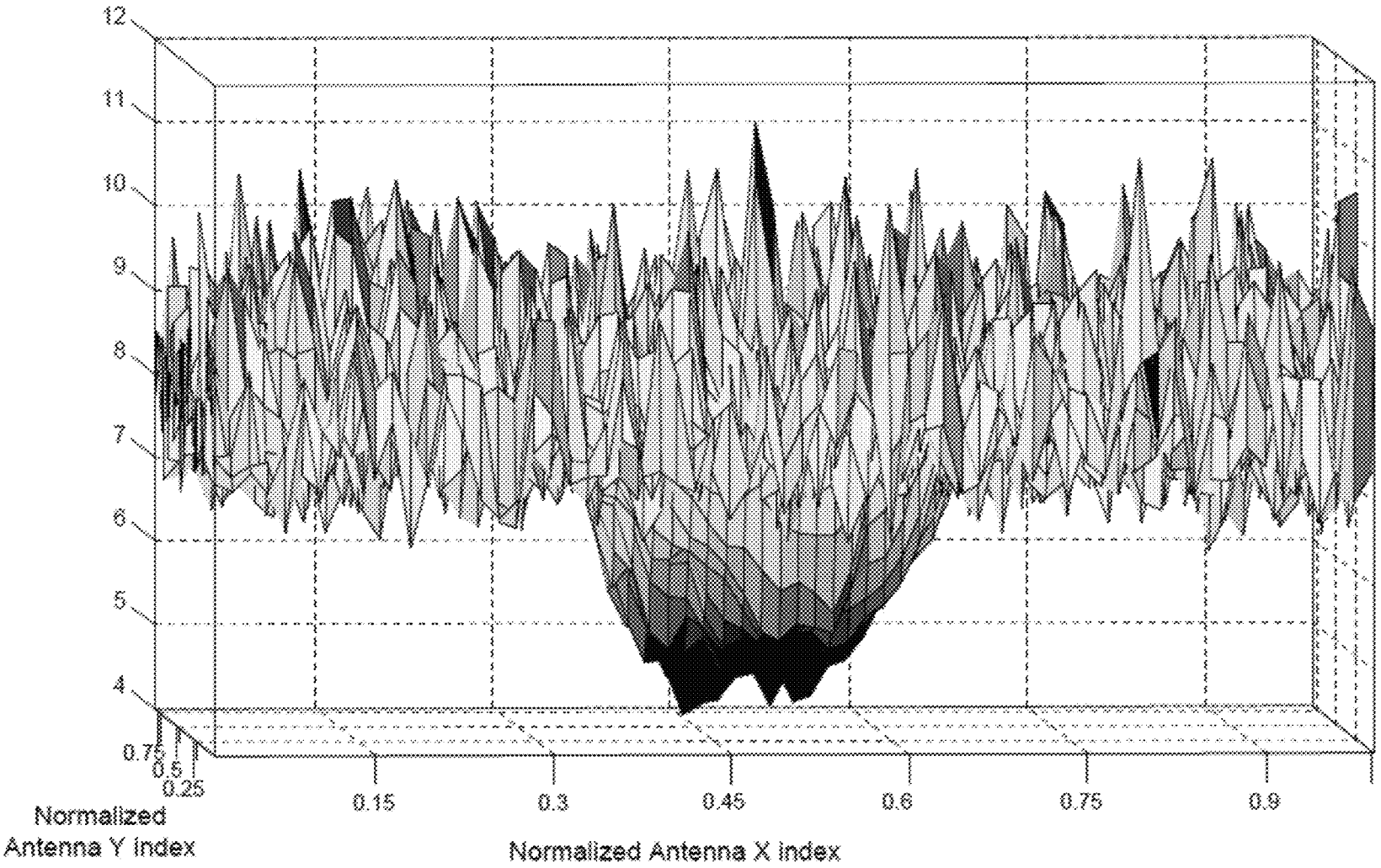
FIG. 7A illustrates an example of per-antenna-element PAPR using a single clipping threshold across all elements of an antenna array.
Figure 7B:
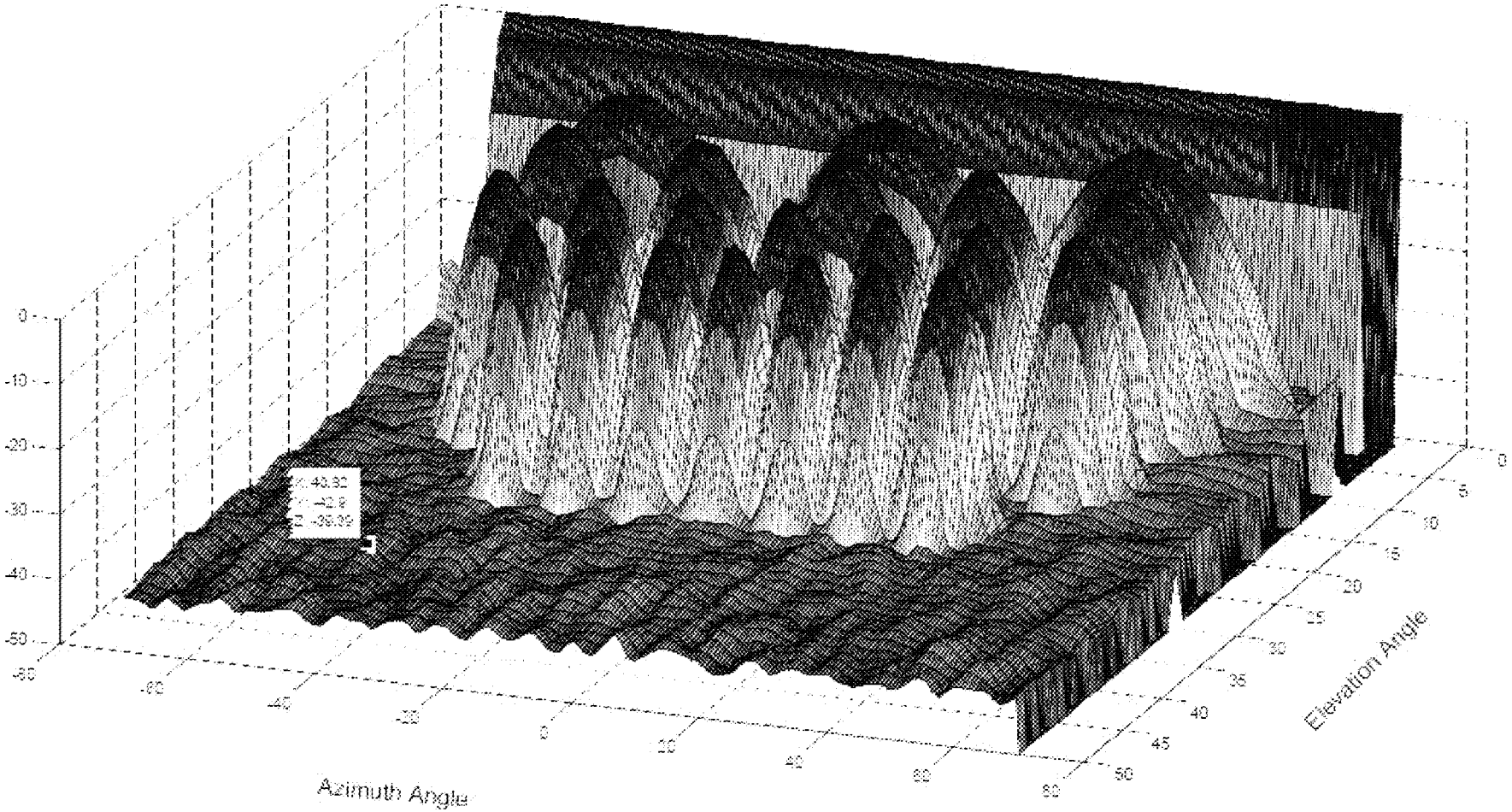
FIG. 7B illustrates an example antenna pattern achieved using the single clipping threshold technique of FIG. 7A.

A first example clipping technique, shown in FIG. 4D, comprises using the same absolute clipping threshold for each of the scaling circuits 462$_n$. In the example shown, each of clipping thresholds $C_1$-$C_9$ is set to a level which is located between 482 and 484. In this example, only signal $\mathbf{463}_5$ may be clipped since the applied window prevents the other signals 463 from reaching the clipping threshold. The cross-hatched area indicates the clipped portion of the signal. Referring briefly to FIG. 7A, using this clipping technique may result in lower PAPR where clipping occurs (near the center element(s) in the example shown). Referring briefly to FIG. 7B, an example antenna pattern comprising 27 desired beams from an array using the clipping scheme of FIG. 4C is shown.

Figure 8A:
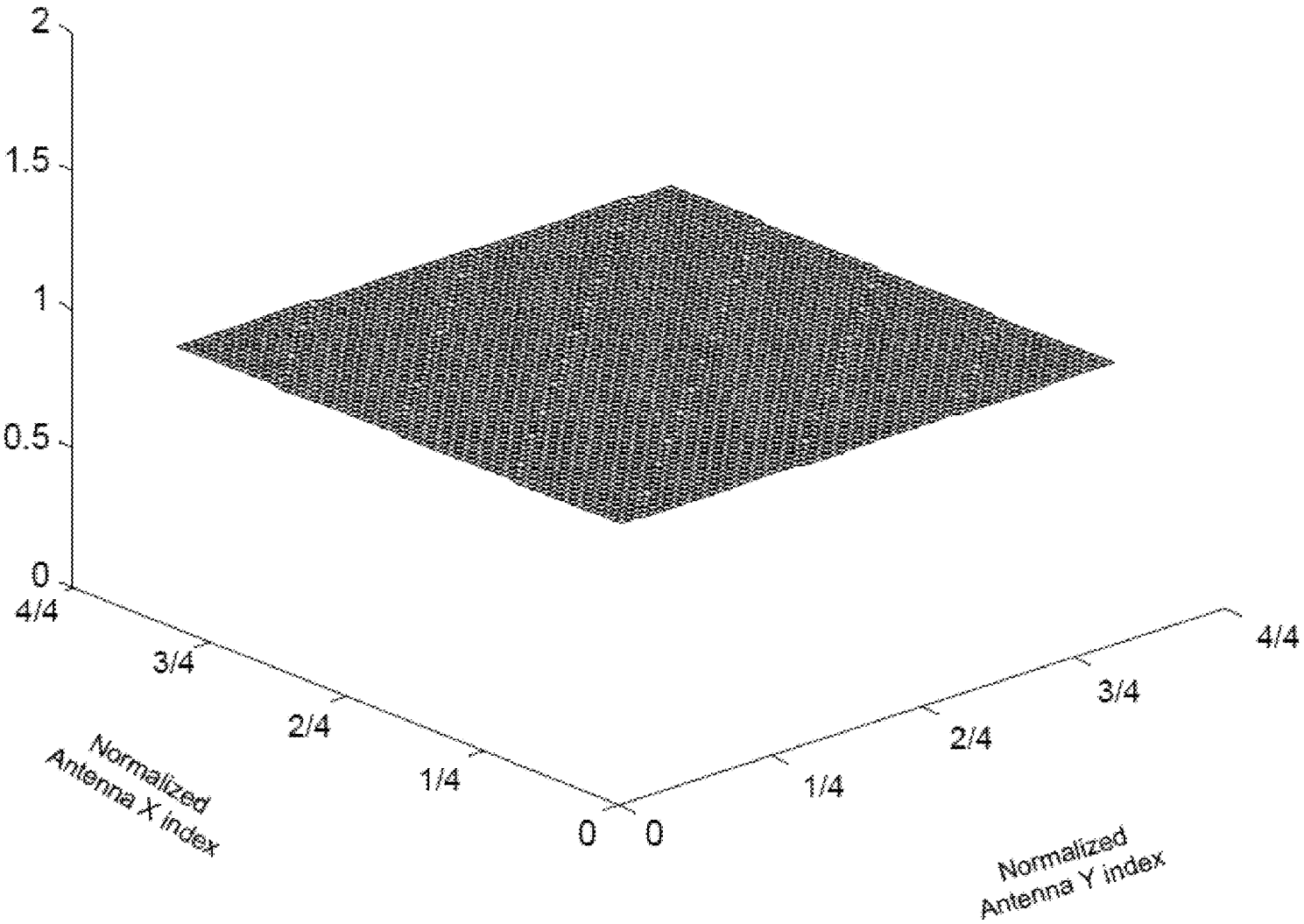
FIG. 8A illustrates an example of per-antenna-element PAPR when each antenna element's clipping threshold is scaled in proportion to the weighting window applied across the antenna array.
Figure 8B:
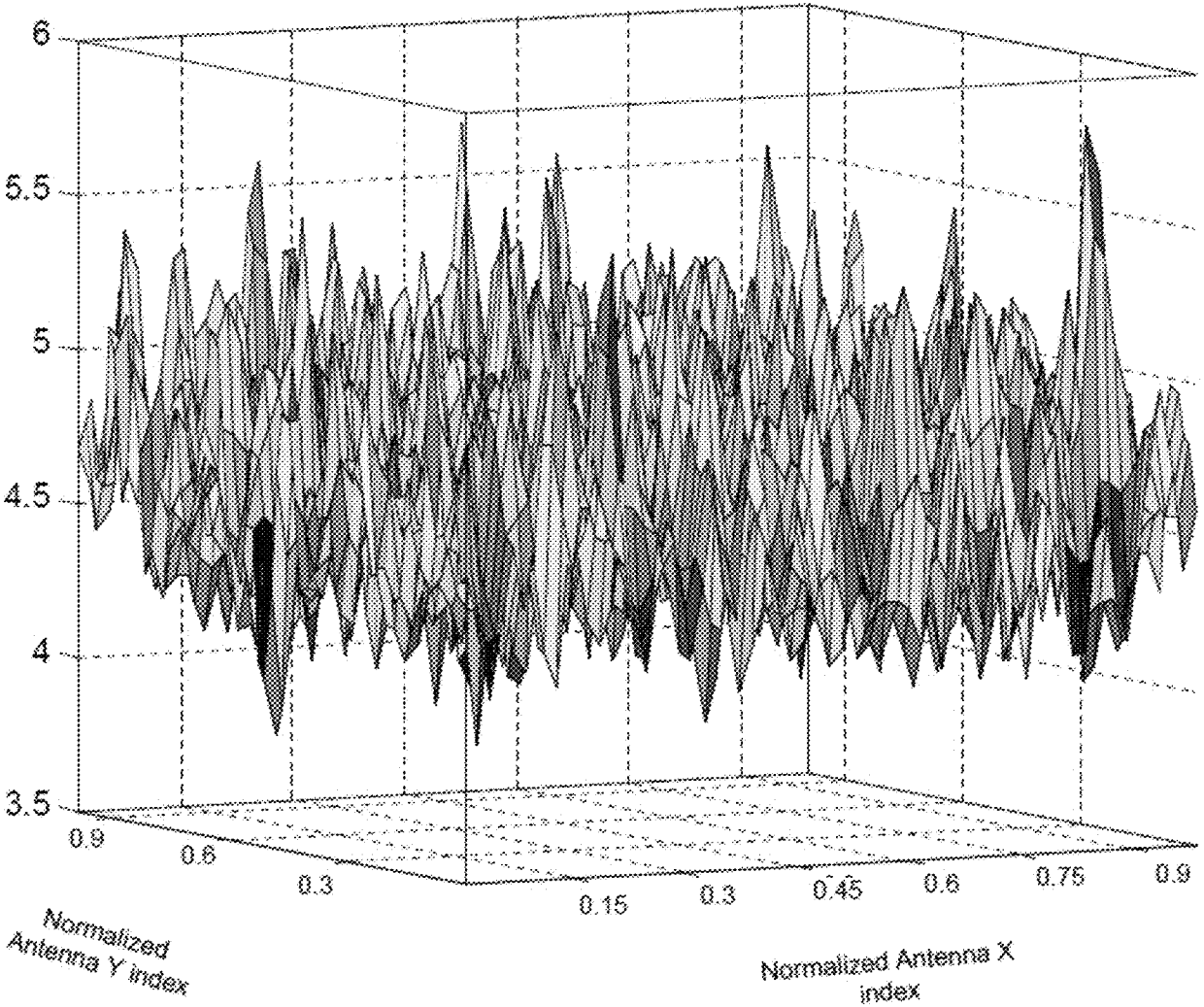
FIG. 8B illustrates an example of per-antenna-element PAPR using the window-weighted clipping technique of FIG. 8A.
Figure 8C:
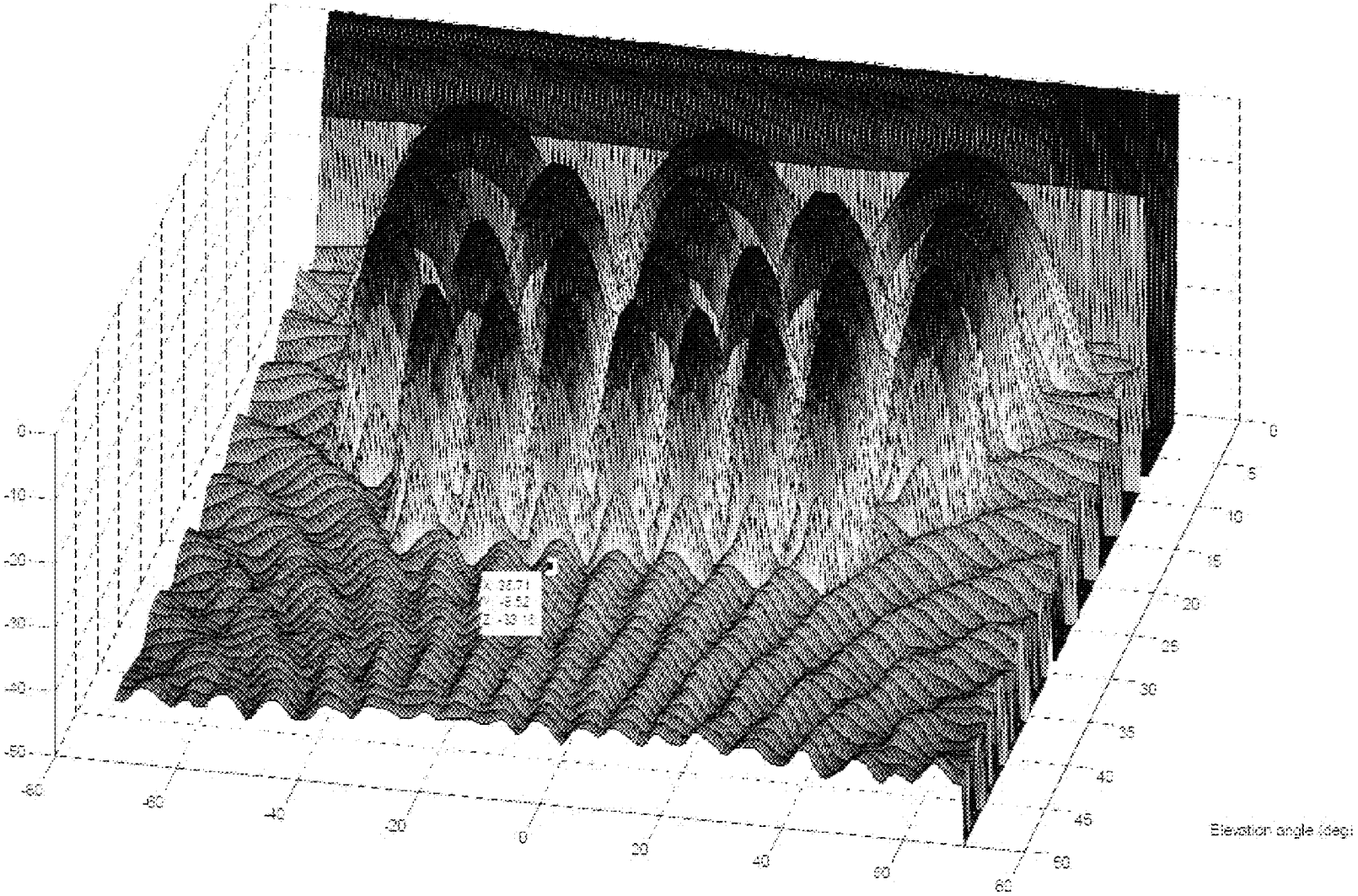
FIG. 8C illustrates an example antenna pattern achieved using the window-weighted clipping technique of FIG. 8A.

A second example clipping technique, shown in FIG. 4E, comprises using the same relative (relative to the weighting window) clipping threshold for each of the antenna elements in the array. In the example shown in FIG. 4E, each of clipping thresholds $C_n$ is set to Δ% below the limit determined by the weighting window (and set by $\mathbf{462}_n$). In this example, up to Δ% of each signal 463 may be clipped. Referring briefly to FIG. 8A, the clipping technique of FIG. 4E is illustrated by a 3D plot showing clipping level relative to the window weighting. As shown in FIG. 8B, this clipping technique may result in relatively uniform PAPR across the array. This uniform PAPR may be desirable but, as shown in FIG. 8C, may come at the cost of increased undesired side lobe levels as compared to FIG. 7B.

Figure 9A:
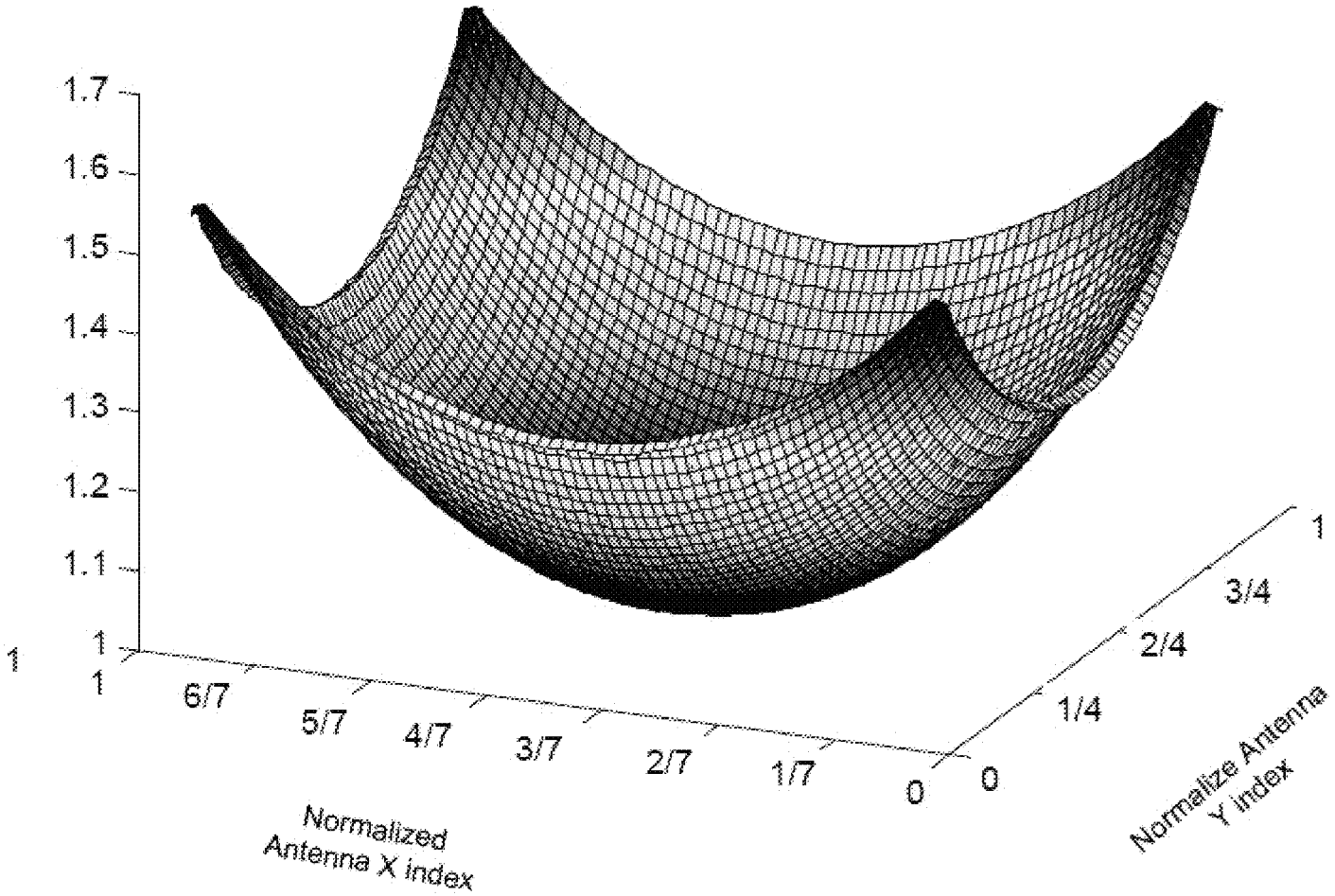
FIG. 9A illustrates an example of per-antenna-element PAPR when using clipping thresholds whose absolute values decrease relative to the weighting window as the distance of the element from the center of the array increases.
Figure 9B:
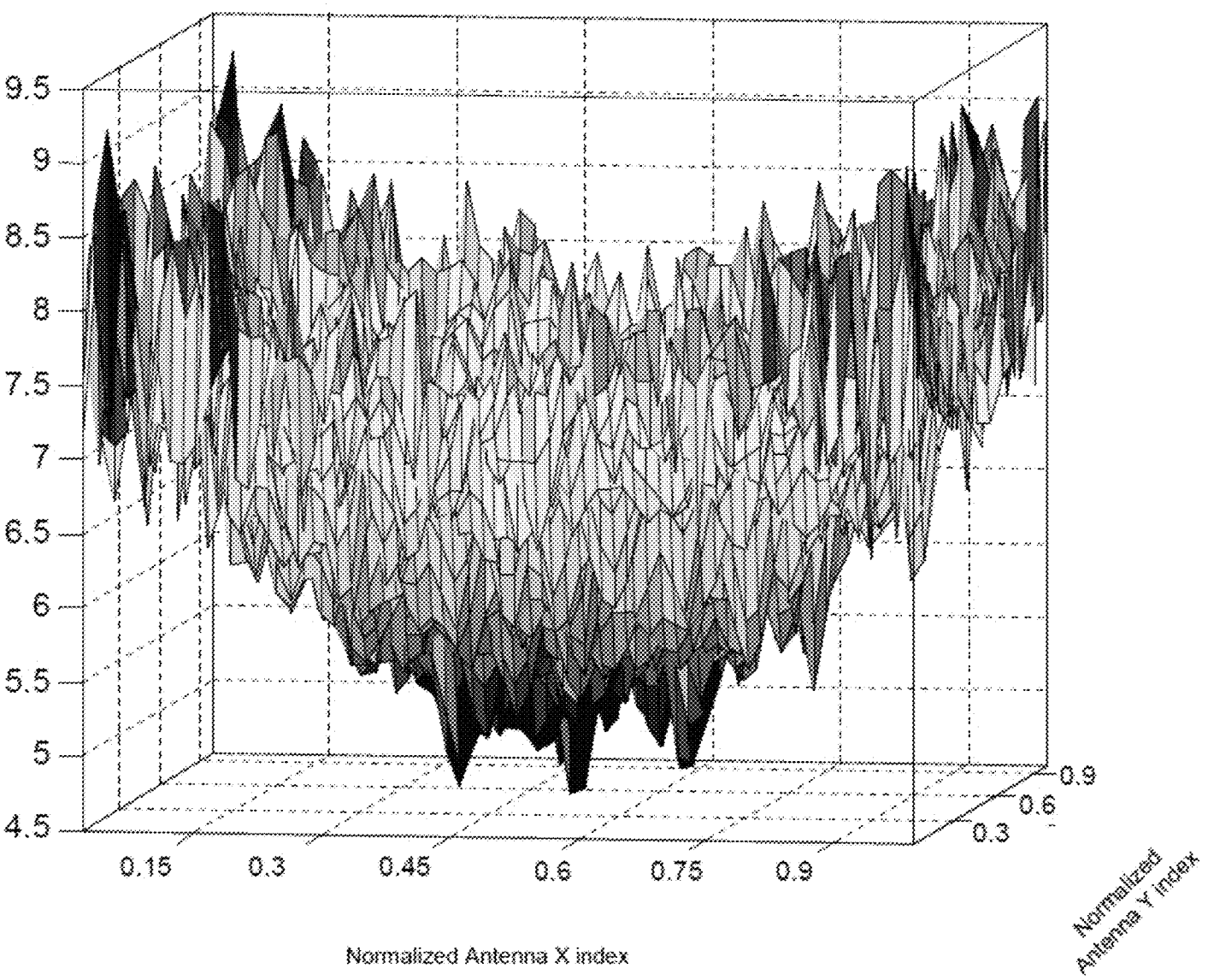
FIG. 9B illustrates an example of per-antenna-element PAPR using the tapered clipping technique of FIG. 9A.
Figure 9C:
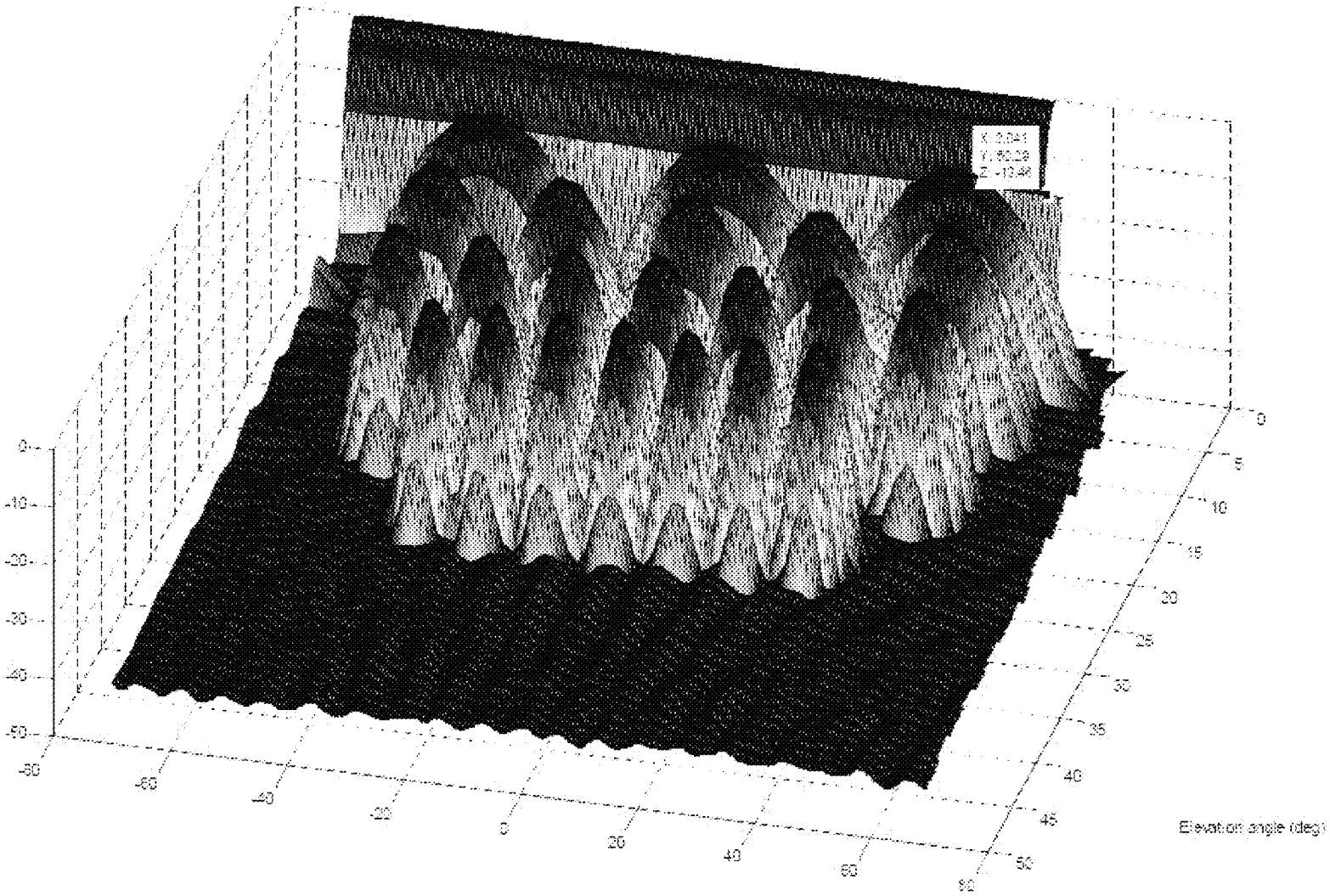
FIG. 9C illustrates an example antenna pattern achieved using the tapered clipping technique of FIG. 9A.

A third example clipping technique, shown in FIG. 4F, comprises using different relative (relative to the weighting window) clipping thresholds for scaling circuits 462. In the example shown in FIG. 4F, the relative threshold is tapered based on distance from the center of the array. That is, $C_5$ is set α% below level 482; $C_2$, $C_4$, $C_6$, and $C_8$ are set β% below 484, and $C_1$, $C_3$, $C_5$, and $C_7$ are set γ% below level 486, wherein $\alpha<\beta<\gamma$. Referring briefly to FIG. 9A, the clipping technique of FIG. 4E is illustrated by a 3D plot showing a clipping level relative to the window weighting for an example implementation. As shown in FIG. 9B, this clipping technique may result in PAPR that tapers off toward the center of the array. As shown in FIG. 9C, this clipping technique may achieve side lobe levels that are between those of FIGS. 7B and 8C.

Figure 5:
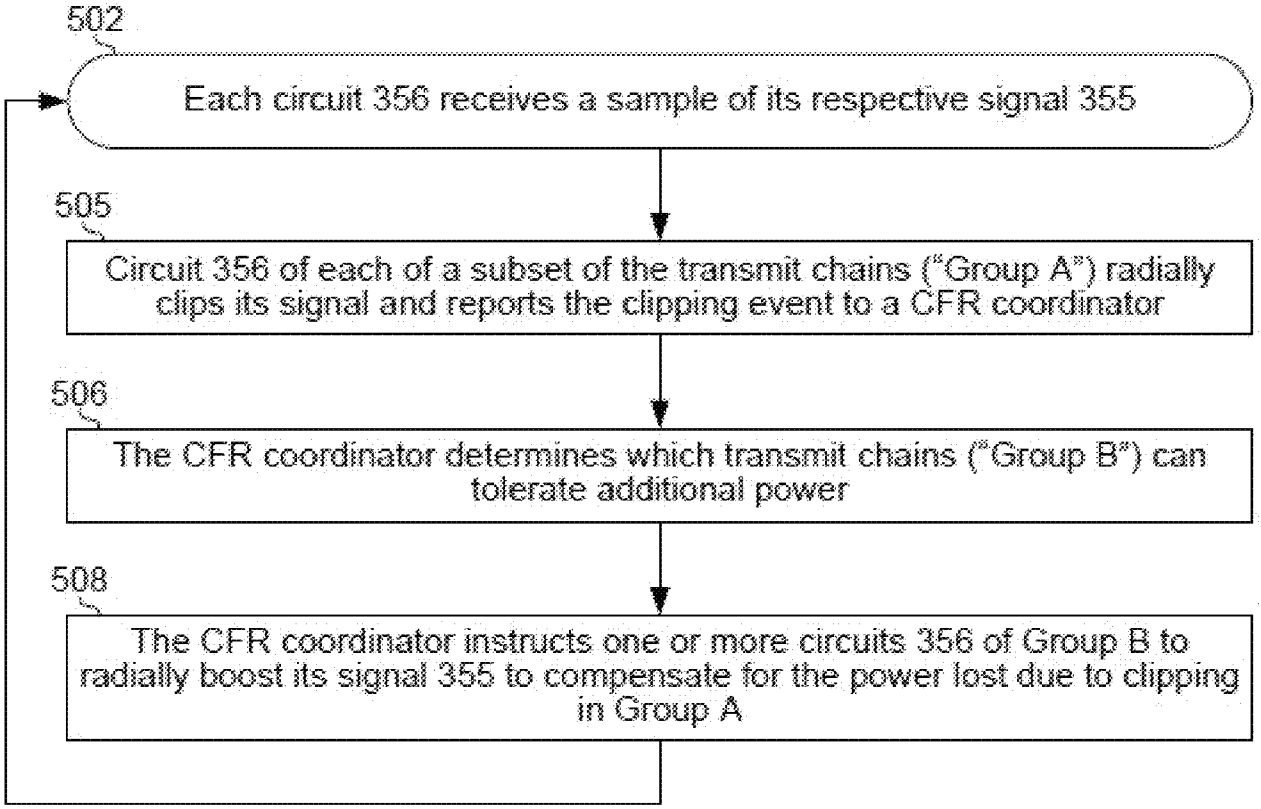
FIG. 5 is a flowchart illustrating an example process for crest factor reduction in accordance with an example implementation of this disclosure.

Now referring to FIG. 5, in block 502, circuit 456 of each transmit chain receives a sample of its respective signal 455. In block 505, circuit 456 of each of a subset of the transmit chains ("Group A") determines that the power of its sample is above a threshold and radially clips (i.e., clips the amplitude without affecting the phase) the sample to a level equal to or below the threshold. In an example implementation, the clipping may comprise a series of clips with filtering in between, with the series of clips and filters configured to optimize out-of-band power and/or in-band EVM.

Each circuit 456 of Group A then reports the clipping event to a CFR coordinator (e.g., one of the circuits 456 of one of the circuits 110 or array 100 may be selected as CFR coordinator based on some selection criteria, a CPU of the device 116 may operate as CFR coordinator, or some other circuitry of the transceiver array 100). In block 506, the CFR coordinator determines which transmit chains ("Group B") can tolerate additional power (e.g., because there is at least a determined amount of headroom between their respective sample powers and the clipping threshold). In block 508, the CFR coordinator computes compensating signals to be applied to one or more of the signal(s) 457 in Group B. The compensating signals may radially boost the power of such signals 457 in Group B a manner that compensates for the power "lost" in Group A due to the clipping. The compensating signal(s) may replace some or all of the power "lost" due to clipping. Due to the fact that the lost power radiates in a certain radiation pattern that can be precomputed (because the lost power only drives antennas elements of Group A), the amplitude and phase of the compensating signal(s) can be computed to restore the signal 457 in the desired directions of each beam. In an example implementation in which N beams are transmitted, each of compensating signals for each of the N beams may be computed individually, and then the N compensating signals may be superimposed. This may be applied in situations where the side lobes produced by the compensating signals are sufficiently low. In other situations, more complex methods for calculating the compensating signals may be used.

Given constant adjacent channel leakage ratio and side-lobe level, the adding back of clipped power may enable a clipping threshold that is 0.5 dB or more below the clipping threshold that would otherwise be required. This translates to significant improvement in PA efficiency.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

Accordingly, the present invention may be realized in hardware, software, or a combination of hardware and software. The present invention may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip. Other embodiments of the invention may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the processes as described herein.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A communications system comprising:

a combining circuit operable to produce a weighted sum of a plurality of digital datastreams, wherein a power of the weighted sum may be above a threshold during one or more time periods;

a crest factor circuit operable to clip the weighted sum when the weighted sum falls above a power threshold; and a phase shifter operable to introduce a phase shift to out-of-band components of the weighted sum when clipping occurs, wherein the out-of-band components of the weighted sum are outside of a transmit band over which information in the plurality of digital datastreams is communicated.

2. The communications system of claim 1, wherein the array based communications system comprises a plurality of wireless transmitters, wherein each wireless transmitter of the plurality of wireless transmitters is operable to transmit a modulated analog signal corresponding to the weighted sum from each of the plurality of element processors.

3. The communications system of claim 2, wherein each of the plurality of wireless transmitters is attached to a horn mounted to a printed circuit board with waveguide feed lines.

4. The communications system of claim 1, wherein a magnitude of a power is reduced by clipping the weighted sum.

5. The communications system of claim 4, wherein the clipping comprise two or more of clips, each clip followed by filtering.

6. The communications system of claim 1, wherein the phase shift is a random phase shift.

7. The array based communications system of claim 1, wherein the phase shift directs the out-of-band components away from a target direction.

8. A method for communications, the method comprising:

generating a plurality of weighted sums from a plurality of digital datastreams;

determining that a weighted sum in the plurality of weighted sums is above a power threshold;

clipping a power of the weighted sum; and shifting a phase of the weighted sum in accordance with the clipping of the weighted sum, wherein the shifting the phase of the weighted sum directs the out-of-band components away from a target direction.

9. The method of claim 8, wherein the method comprises wirelessly transmitting a plurality of modulated analog signals corresponding to the plurality of weighted sums.

10. The method of claim 8, wherein clipping reduces a power magnitude.

11. The method of claim 8, wherein clipping comprises two or more of clips, each clip followed by filtering.

12. The method of claim 8, wherein shifting the phase of the weighted sum comprises shifting by a random phase shift.

13. A non-transitory machine-readable storage having stored thereon, a computer program having at least one code section for networking, the at least one code section being executable by a machine for causing the machine to perform steps comprising:

generating a plurality of weighted sums from a plurality of digital datastreams;

determining that a weighted sum in the plurality of weighted sums is above a power threshold;

clipping a power of the weighted sum; and shifting a phase of the weighted sum in accordance with a power reduction of the weighted sum, wherein the shifting the phase of the weighted sum directs the out-of-band components away from a target direction.

14. The non-transitory machine-readable storage of claim 13, wherein the at least one code section is executable by the machine for causing the machine to wirelessly transmit a plurality of modulated analog signals corresponding to the plurality of weighted sums.

15. The non-transitory machine-readable storage of claim 13, wherein clipping reduces a power magnitude.

16. The non-transitory machine-readable storage of claim 13, wherein clipping a power magnitude comprises two or more of clips, each clip followed by filtering.

17. The non-transitory machine-readable storage of claim 13, wherein shifting the phase of the weighted sum comprises shifting by a random phase shift.

18. A wireless device comprising the non-transitory machine-readable storage of claim 13.

* * * * *